US005869935A

United States Patent [19]

Sodhi

[11] Patent Number: 5,869,935

[45] Date of Patent: Feb. 9, 1999

[54] ELECTRONIC BALLAST WITH INVERTER PROTECTION CIRCUIT

[75] Inventor: Sameer Sodhi, Palatine, Ill.

[73] Assignee: Motorola Inc., Schaumburg, Ill.

[21] Appl. No.: 852,638

[22] Filed: May 7, 1997

[51] Int. Cl.[6] ..... H05B 37/02

[52] U.S. Cl. ..... 315/225; 315/127; 315/307

[58] Field of Search ..... 315/225, 224, 315/127, 307, DIG. 5, 291, 209 R

[56] References Cited

U.S. PATENT DOCUMENTS

| | | | |
|---|---|---|---|
| 4,554,487 | 11/1985 | Nilssen | 315/224 |
| 4,902,938 | 2/1990 | Lindquist | 315/307 |
| 4,972,124 | 11/1990 | Powers | 315/219 |
| 4,983,887 | 1/1991 | Nilssen | 315/224 |
| 5,068,573 | 11/1991 | Bruning et al. | 315/209 R |
| 5,130,611 | 7/1992 | Johns | 315/224 |
| 5,394,062 | 2/1995 | Minarczyk et al. | 315/129 |
| 5,449,979 | 9/1995 | Ueoka et al. | 315/225 |
| 5,461,287 | 10/1995 | Russell et al. | 315/209 R |

*Primary Examiner*—Hoanganh Le
*Assistant Examiner*—David H. Vu
*Attorney, Agent, or Firm*—Kenneth D. Labudda; Gary J. Cunningham

[57] ABSTRACT

An electronic ballast (10) for powering at least one gas discharge lamp (20) comprising an AC-to-DC converter (100), an inverter (200), an output circuit (300), and an inverter protection circuit (400). Inverter protection circuit (400) includes a high voltage detection circuit (500), a no-load detection circuit (600), and a latch circuit (700), and is operable to turn off the inverter (200) in response to removal or failure of the gas discharge lamps. Inverter protection circuit (400) is well-suited for use in ballasts that power multiple, parallel-connected lamps and maintains operation of inverter (200) under a partially-loaded condition in which at least one operational lamp is present and each of the failed lamps has at least one open filament.

21 Claims, 4 Drawing Sheets

ELECTRONIC BALLAST WITH INVERTER PROTECTION CIRCUIT

FIELD OF THE INVENTION

The present invention relates to the general subject of circuits for powering gas discharge lamps and, in particular, to an electronic ballast with an inverter protection circuit.

BACKGROUND OF THE INVENTION

Electronic ballasts typically include an inverter that provides high frequency current for efficiently powering gas discharge lamps. Inverters are generally classified according to their topology (e.g., half-bridge or push-pull) and the method used to control commutation of the inverter switches (e.g., driven or self-oscillating). In many types of electronic ballasts, the inverter is a driven half-bridge in which two alternately conducting power transistors are used to provide a square wave output voltage. The square wave output voltage of the inverter is processed by a resonant output circuit that provides high voltage for igniting the lamps, as well as a magnitude-limited current for powering the lamps.

When the lamps fail, are removed, or otherwise cease to operate in a normal fashion, it is highly desirable that the inverter be shut down or shifted to a different mode of operation. This is necessary in order to minimize power dissipation, reduce heating in the ballast, and protect the inverter transistors from damage due to excessive voltage, current, and heat. Circuits that shut down or alter the operation of the inverter in response to lamp removal or failure are customarily referred to as inverter protection circuits.

One known type of inverter protection circuit monitors the resonant output circuit for overvoltage and correspondingly turns the inverter driver circuit off if the voltage exceeds a certain level. This approach is not attractive for those ballasts in which the lamps are "direct coupled" in series with the resonant circuit, since removal or failure of the lamps actually opens the resonant circuit and thereby prevents the development of high voltage in the resonant circuit. However, even with the resonant circuit open, the inverter continues to operate, resulting in unnecessary power dissipation in the inverter switches.

Another known approach utilizes a current path through the lamp filaments to detect lamp removal or failure. This approach alone is inadequate for those situations in which a lamp fails to operate in a normal manner, but its filaments remain intact, such as what occurs with "degassed" and "diode mode" lamps. Furthermore, if multiple lamps are present, and if a single current path through the filaments of all the lamps is used, the inverter is shut down even if only one filament of one lamp fails but the remaining lamps are operational and with their filaments intact. This is unnecessary and undesirable, since it is preferred to have the inverter continue to operate so that the remaining operational lamps may continue to provide illumination, thus obviating any urgent need for replacement of the single failed lamp.

It is therefore apparent that a need exists for an inverter protection circuit for a driven half-bridge type inverter that provides protection of the inverter switches and other ballast components under various lamp failure modes, such as lamp removal or a degassed lamp, but that allows the inverter to continue to operate when at least one operational lamp is present and when the failed lamps present no danger to the inverter. Such a circuit would represent a considerable advance over the prior art.

DETAILED DESCRIPTION OF THE PREFERRED EMBODIMENTS

Figure 1:
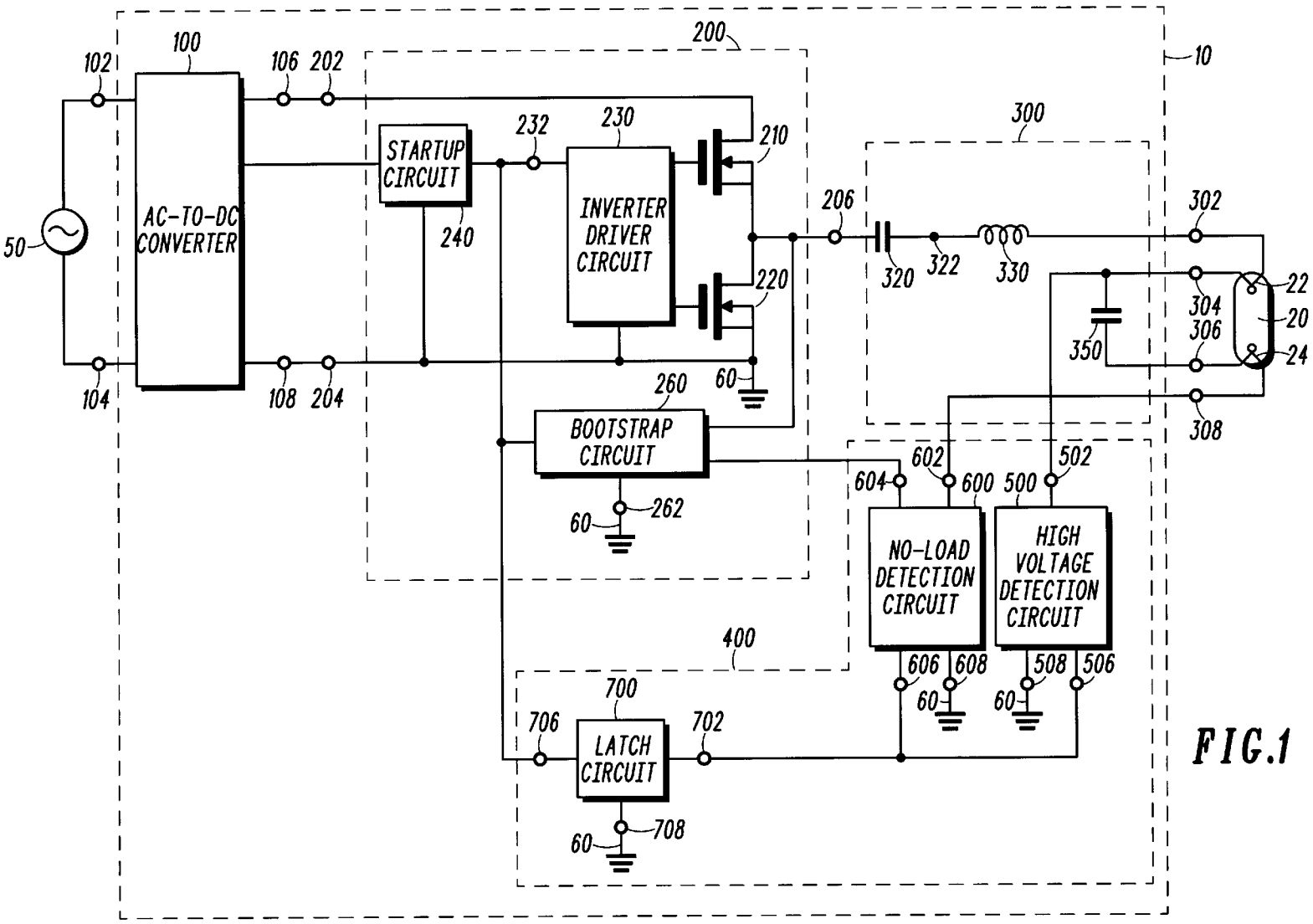
FIG. 1 is a bock diagram of an electronic ballast with an inverter protection circuit, in accordance with the present invention.

An electronic ballast 10 for powering at least one gas discharge lamp 20 is described in FIG. 1. Ballast 10 comprises an alternating current (AC) to direct current (DC) converter 100, an inverter 200, an output circuit 300, and an inverter protection circuit 400. Ballast 10 also includes a set of output wires 302, . . . ,308 adapted to being coupled to gas discharge lamp 20. Specifically, first output wire 302 is coupleable to second output wire 304 through a first filament 22 of lamp 20, and third output wire 306 is coupleable to fourth output wire 308 through a second filament 24 of lamp 20.

AC-to-DC converter 100 includes a pair of input connections 102,104 for receiving a source of alternating current 50, and a pair of output connections 106,108. Inverter 200 comprises first and second input terminals 202,204, an output terminal 206, a first inverter switch 210, a second inverter switch 220, an inverter driver circuit 230, a startup circuit 240, and a bootstrap circuit 260. First and second input terminals 202,204 are coupled to the output connections 106,108 of AC-to-DC converter 100. Second input terminal 204 is also coupled to a circuit ground node 60. First inverter switch 210 is coupled between first input terminal 202 and output terminal 206, while second inverter switch 220 is coupled between output terminal 206 and circuit ground node 60. First and second inverter switches 210,220 may be implemented using any of a number of controllable power switches, such as field-effect transistors (shown in FIG. 1) or bipolar junction transistors.

Inverter driver circuit 230 is coupled to, and operable to complementarily commutate, first and second inverter switches 210,220. That is, inverter driver circuit 230 controls conduction of inverter switches 210,220 so that when first switch 210 is on, second switch 220 is off, and vice versa. Inverter driver circuit 230, which may be implemented using a discrete circuit or an integrated circuit (IC) such as the IR2151 high-side driver IC manufactured by International Rectifier, includes a DC supply input 232 for receiving operating power. Startup circuit 240, coupled between AC-to-DC converter 100 and DC supply input 232, is operable to provide power for initiating operation of inverter driver circuit 230. Bootstrap circuit 260 is coupled between output terminal 206 and DC supply input 232 of inverter driver circuit 230, and includes a ground connection 262 coupled to circuit ground node 60. During operation, bootstrap circuit 260 provides steady-state operating power to inverter driver circuit 230.

Output circuit 300 comprises a direct current (DC) blocking capacitor 320, a resonant inductor 330, and a resonant capacitor 350. DC blocking capacitor 320 is coupled between inverter output terminal 206 and a first junction 322. Resonant inductor 330 is coupled between first junction 322 and first output wire 302. Resonant capacitor 350 is coupled between second output wire 304 and third output wire 306. Output circuit 300 is configured as a series resonant circuit that provides a high voltage for igniting lamp 20 and a magnitude-limited current for steady-state powering of lamp 20. Additionally, output circuit 300 is often referred to as a direct-coupled arrangement, in that physical disconnection of lamp 20 from output wires 302, . . . , 308, or failure of either of the lamp filaments 22,24, effectively disconnects resonant capacitor 350 from the rest of output circuit 300. Thus, output circuit 300 provides the advantage of automatically shutting off the resonant circuit, and therefore preventing an otherwise high voltage from developing across resonant capacitor 350, in response to removal of, or open filaments in, lamp 20.

Despite the fact that output circuit 300 will shut off when lamp 20 is removed or when either one or both of filaments 22,24 become open, inverter driver circuit 230 will, in the absence of additional protection measures, continue to operate and provide switching of inverter switches 210,220. Consequently, inverter switches 210,220 will needlessly dissipate a considerable amount of power. Hence the need for a protection circuit to reduce or eliminate unnecessary power dissipation in the inverter switches when lamp 20 is removed or failed.

The need for a protection circuit becomes considerably more urgent if lamp 20 is, or at some point at the end of its operating life becomes, a "degassed" or "diode mode" lamp. In this case, output circuit 300 will not automatically shut off since filaments 22,24 will remain intact for at least a short period of time, thus keeping resonant capacitor 350 connected to the rest of output circuit 300. With lamp 20 degassed, for example, the voltages across resonant inductor 330 and resonant capacitor 350 will become extremely high since little or no loading is presented by the degassed lamp. The result is exposure of inverter switches 210,220 and output circuit 300 to potentially destructive levels of voltage, current, and power dissipation. In order to prevent such a situation, a protection circuit is needed that shuts down, or at least significantly alters the operation of, inverter driver circuit 230 in response to lamp 20 failing to conduct current in a substantially normal manner.

As described in FIG. 1, protection circuit 400 comprises a high voltage detection circuit 500, a no-load detection circuit 600, and a latch circuit 700. High voltage detection circuit includes a high voltage detect input 502 coupled to second output wire 304, a ground connection 508 coupled to circuit ground node 60, and a high voltage detect output 506. No-load detection circuit includes a no-load detect input 602 coupled to fourth output wire 308, a bootstrap detect input 604 coupled to bootstrap circuit 260, a no-load detect output 606 coupled to high voltage detect output 506, and a ground connection 608 coupled to circuit ground 60. Latch circuit 700 includes a latch input 702 coupled to no-load detect output 606, a latch output 706 coupled to the DC supply input 232 of inverter driver circuit 230, and a ground connection 708 coupled to circuit ground node 60.

Inverter protection circuit 400 is operable, in response to removal or failure of lamp 20, to turn off inverter driver circuit 230 by coupling the DC supply input 232 of inverter driver circuit 230 to circuit ground node 60. With DC supply input 232 coupled to circuit ground node 60, inverter driver circuit 230 is deprived of operating power and turns off. Thus, inverter protection circuit 400 supplements the insufficient degree of protection afforded by output circuit 300 by shutting down inverter 200 in when lamp 20 fails or is removed.

In a preferred embodiment of electronic ballast 10, inverter protection circuit 400 is operable to inactivate inverter driver circuit 230 by coupling DC supply input 232 to circuit ground node 60 in response to one or both of the following conditions: (1) the voltage at the high voltage detect input 502 being greater than a predetermined over-voltage threshold, $V_{HIGH}$; and (2) the current flowing into the no-load detect input being less than a predetermined no-load threshold, $I_{LOW}$. Referring to FIG. 1, the first condition occurs when lamp 20 is degassed or in diode mode, or when lamp 20 otherwise fails to conduct current in a substantially normal manner. The second condition occurs when lamp 20 is removed or when one or both of filaments 22,24 are open.

Figure 2:
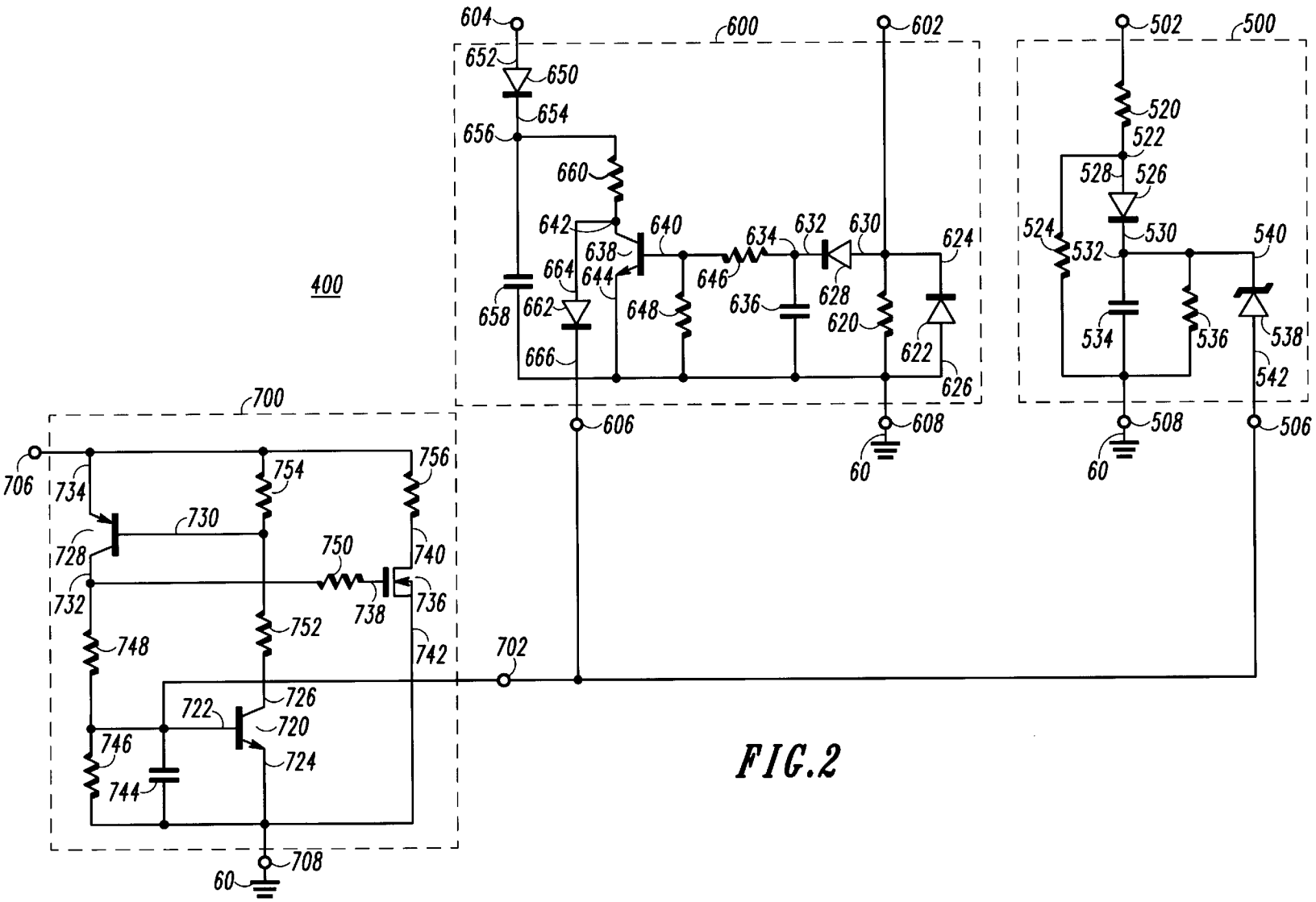
FIG. 2 is schematic diagram of an inverter protection circuit, in accordance with a preferred embodiment of the present invention.

Turning now to FIG. 2, in a preferred embodiment of inverter protection circuit 400, high voltage detection circuit 500 comprises a first resistor 520, a second resistor 524, a diode 526, a capacitor 534, a third resistor 536, and a zener diode 538. First resistor 520 is coupled between high voltage detect input 502 and a first node 522. Second resistor 524 is coupled between first node 522 and circuit ground node 60. Diode 526 has an anode 528 coupled to first node 522 and a cathode 530 coupled to a second node 532. Capacitor 534 and third resistor 536 are each coupled between second node 532 and circuit ground node 60. Zener diode 538 has a cathode 540 coupled to second node 532 and an anode 542 coupled to high voltage detect output 506.

During operation, high voltage detect circuit 500 monitors the voltage, $V_{OUT}$, at the second output wire 304 and provides an output voltage at high voltage detect output 506 if $V_{OUT}$ exceeds $V_{HIGH}$. Conversely, as long as $V_{OUT}$ is less than $V_{HIGH}$, no voltage is provided at output 506. First resistor 520 and second resistor 524 function as a voltage divider circuit for transferring a fractional portion of $V_{OUT}$ into capacitor 534 via first diode 526. Diode 526 serves as a rectifier that allows capacitor 534 to charge up during the positive half cycles of $V_{OUT}$ and prevents capacitor 534 from discharging during the negative half cycles of $V_{OUT}$. Zener diode 538 acts as a threshold trigger that turns on (i.e., reverse conducts) and delivers current to high voltage detect output 506 if the voltage across capacitor 534 attempts to exceed the zener voltage, $V_Z$, of zener diode 538. The resistances of divider resistors 520,524 are selected so that $V_{OUT}$ exceeding $V_{HIGH}$ correspondingly causes the voltage across capacitor 534 to attempt to exceed $V_Z$. Resistors 520,524 and capacitor 534 also provide a useful RC time delay that prevents high voltage detection circuit 500 from providing an output voltage that effects engagement of latch circuit 700 until some time after lamp 20 has first been given a reasonable period of time in which to ignite. Resistor 536 serves as a reset resistor for discharging capacitor 534 when AC power is removed from the ballast so that, upon reapplication of AC power, high voltage detection circuit 500 provides a reasonably consistent delay period to allow for ignition of lamp 20.

Referring again to FIG. 2, in a preferred embodiment of inverter protection circuit 400, no-load detection circuit comprises a first resistor 620, a first diode 622, a second diode 628, a first capacitor 636, an electronic switch 638, a second resistor 646, a third resistor 648, a third diode 650, a second capacitor 658, a fourth resistor 660, and a fourth diode 662. First resistor 620 is coupled between no-load detect input 602 and circuit ground node 60. First diode 622 has a cathode 624 coupled to no-load detect input 602 and an anode 626 coupled to circuit ground node 60. Second diode 628 has an anode 630 coupled to no-load detect input 602 and a cathode 632 coupled to a first node 634. First capacitor 636 is coupled between first node 634 and circuit ground node 60. Electronic switch 638 is preferably implemented using a NPN-type bipolar junction transistor (BJT) having a base lead 640, a collector lead 642, and an emitter lead 644. Emitter lead 644 is coupled to circuit ground node 60. Second resistor 646 is coupled between first node 634 and base lead 640. Third resistor 648 is coupled between base lead 640 and circuit ground node 60. Third diode 650 has an anode 652 coupled to bootstrap detect input 604 and a cathode 654 coupled to a second node 656. Second capacitor 658 is coupled between second node 656 and circuit ground node 60. Fourth resistor 660, which serves as a current limiting resistor for transistor 638, is coupled between second node 656 and collector lead 642. Fourth diode 662 has an anode 664 coupled to collector lead 642 and a cathode 666 coupled to no-load detect output 606.

Referring back to FIG. 1, the current that flows out of third output wire 306, through second filament 24, and back into fourth output wire 308 is herein referred to as the "return current." During operation of ballast 10, no-load detection circuit 600 monitors the return current, which flows into no-load detect input 602, as an indicator of whether or not a lamp with both filaments intact is indeed connected to the ballast. Returning now to FIG. 2, a portion of the positive-going half cycles of the return current flows to circuit ground through resistor 620, thus providing a voltage across resistor 620 that is proportional to the magnitude of the return current. The negative-going half cycles flow up from circuit ground node 60 through diode 622, which serves as a bypass diode for reducing the amount of power dissipated in resistor 620.

If a return current is present, indicating that at least one lamp with intact filaments is connected to the ballast, capacitor 636 will charge up during the positive-going half-cycles of the return current. Resistors 646,648 scale down the voltage across capacitor 636 for application to the base lead 640 of transistor 638. Once the voltage across resistor 648 becomes sufficiently high, transistor 638 turns on and remains on as long as a return current is present. With transistor 638 on, diode 662 is reverse-biased since its anode 664 is effectively coupled to near ground potential through transistor 638. Consequently, no-load detect output is prevented from developing a voltage sufficient to effect engagement of latch circuit 700. If, on the other hand, no return current is present, transistor 638 does not turn on. With transistor 638 off, the voltage at bootstrap detect input 604, which develops shortly after inverter switching commences, is substantially transferred to no-load detect output 606. Consequently, latch circuit 700 becomes engaged and inactivates inverter driver circuit 230.

Referring again to FIG. 2, latch circuit 700 comprises a first electronic switch 720, a second electronic switch 728, a third electronic switch 736, a first capacitor 744, a first resistor 746, a second resistor 748, a third resistor 750, a fourth resistor 752, a fifth resistor 754, and a sixth resistor 756. First electronic switch 720 preferably comprises a NPN-type BJT having a base lead 722 coupled to latch input 702, an emitter lead 724 coupled to circuit ground node 60, and a collector lead 726. Second electronic switch 728 preferably comprises a PNP-type BJT having a base lead 730, a collector lead 732, and an emitter lead 734. Emitter lead 734 is coupled to latch output 706. Third electronic switch 736 preferably comprises a N-channel field effect transistor (FET) having a gate lead 738, a drain lead 740, and a source lead 742. Source lead 742 is coupled to circuit ground node 60. For improved operation of latch circuit 700, it is further preferred that transistor 736 be implemented using an insulated gate enhancement-mode FET, such as the 2N7002 manufactured by Motorola, Inc., that is capable of turning on, and remaining on, for relatively low values of gate-to-source voltage (e.g., on the order of about 2 volts) and drain-to-source voltage. First capacitor 744 and first resistor 746 are each coupled between latch input 702 and circuit ground node 60. Second resistor 748 is coupled between latch input 702 and the collector lead 732 of transistor 728. Third resistor 750 is coupled between collector lead 732 and the gate lead 738 of transistor 736. Fourth resistor 752 is coupled between the collector lead 726 of transistor 720 and the base lead 730 of transistor 728. Fifth resistor 754 is coupled between latch output 706 and base lead 730. Finally, sixth resistor 756 is coupled between latch output 706 and the drain lead 740 of transistor 736.

The operation of latch circuit 700 is now explained with reference to FIGS. 1 and 2 as follows. In response to a lamp fault condition, high voltage protection circuit 500 and/or no-load detection circuit 60, provide a voltage, Vlatch, at latch input 702 that is sufficient (i.e., at least 0.7 volts or so) to cause transistor 720 to turn on. When inverter 200 is operating, latch output 706 has a voltage, $V_{DC}$, on the order of around 15 volts that, once transistor 720 turns on, is distributed between resistors 752,754. Consequently, transistor 728 becomes forward-biased and turns on. With transistor 728 on, the voltage at collector lead 732 becomes high enough to turn on transistor 736. Once transistor 736 turns on, latch output 706 is then coupled, by way of resistor 756, to circuit ground node 60, thus effectively shunting DC supply input 232 to ground and turning off inverter driver circuit 230. Once inverter driver circuit 230 turns off, transistor 736 will remain on (due to current provided by startup circuit 240) and actively prevent the voltage at DC supply input 232 from building up and reaching a level sufficient to initiate operation of inverter driver circuit 230. That is, latch circuit 700 remains on until at least such time as AC power is removed from ballast 10. Once engaged, latch circuit 700 disengages only after AC power is removed from ballast 10.

Figure 3:
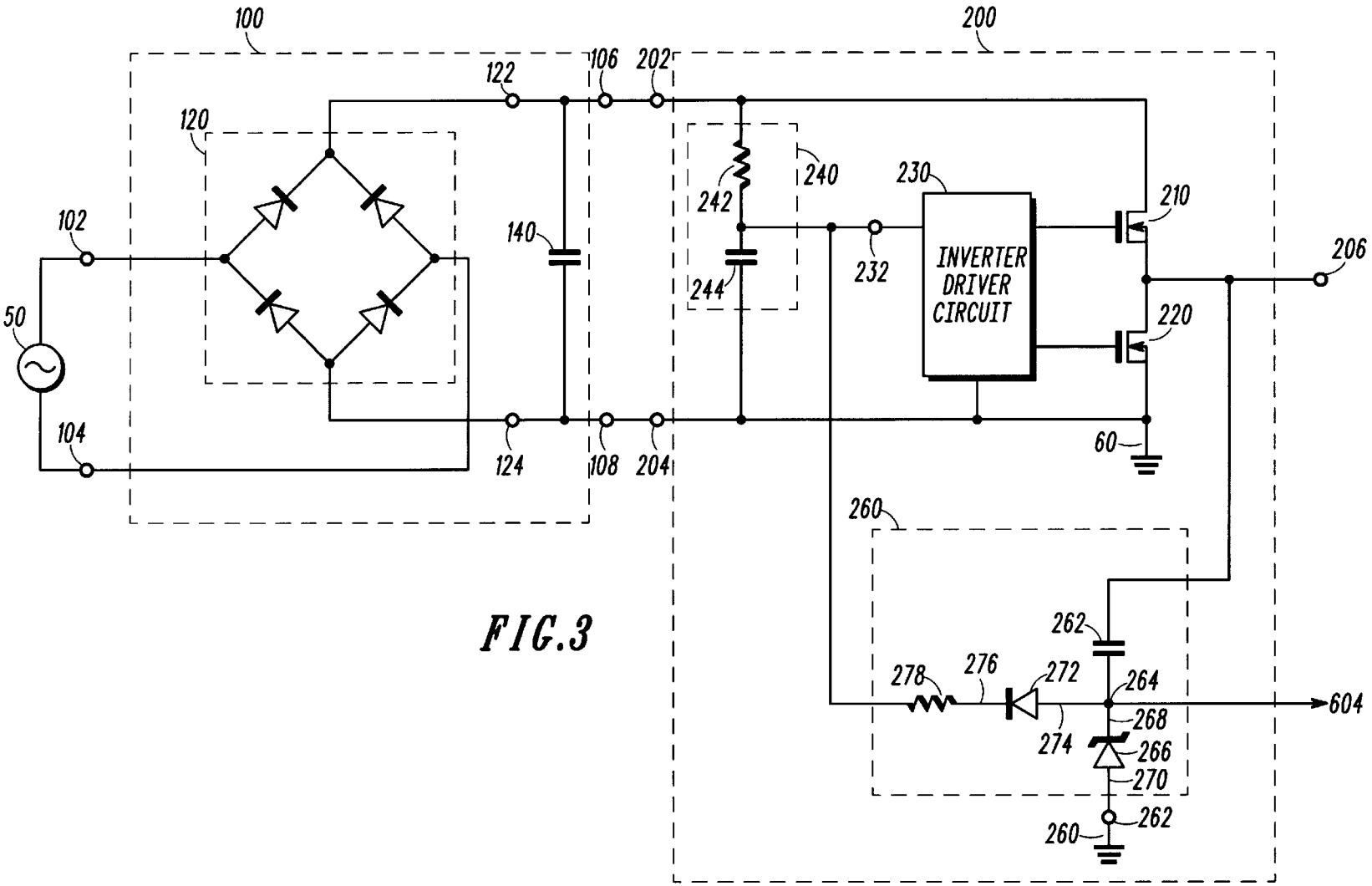
FIG. 3 is a schematic diagram of an AC-to-DC converter and an inverter, in accordance with a preferred embodiment of the present invention.

Turning now to FIG. 3, AC-to-DC converter 100 preferably includes a rectifier circuit 120 that is operable to accept the source of alternating current 50 and to provide a rectified voltage between a pair of rectifier circuit output terminals 122,124. AC-to-DC converter 100 may also include a filtering capacitor 140 for reducing the amount of AC ripple present in the output voltage provided by rectifier circuit 100. AC-to-DC converter 100 may also include a boost converter (not shown), inserted between output terminals 122,124 and output connections 106,108, for providing power factor correction and line regulation.

Preferred implementations for startup circuit 240 and bootstrap circuit 260 are also illustrated in FIG. 3. Startup circuit 240 preferably comprises a resistor 242 coupled between DC supply input 232 and output terminal 122 of rectifier circuit 120, and a capacitor 244. Bootstrap circuit 260 comprises a capacitor 262, a zener diode 266, a diode 272, and a resistor 278. Capacitor 262 serves as an AC coupling capacitor for extracting a limited amount of current from inverter output terminal 206 and is coupled between the inverter output terminal 206 and a first node 264. First node 264 is coupled to the bootstrap detect input 604 of no-load detection circuit 600. Zener diode 266, which functions as a voltage regulator that safely limits the amount of voltage provided to DC supply input 232, has a cathode 268 coupled to first node 264 and an anode 270 coupled to circuit ground node 60. Diode 272, which serves as a rectifier for transferring only positive-going current to DC supply input 232, has a cathode 276 and an anode 274 that is coupled to first node 264. Resistor 278 is a current limiting element and is coupled between DC supply input 232 and cathode 276 of diode 272.

When AC power is first applied to the ballast, capacitor 244 is initially uncharged, and inverter driver circuit 230 is off and remains off until such time as the voltage, $V_{DC}$, at DC supply input 232 reaches a certain level. With AC power applied to the ballast, rectifier circuit 120 provides a full-wave rectified voltage across output terminals 122,124, and capacitor 244 begins to charge up due to current delivered to it via resistor 242. Once the voltage across capacitor 244 reaches a certain predetermined level (e.g., 8.2 volts), inverter driver circuit 230 turns on and, using the energy stored in capacitor 244, begins switching of inverter switches 210,220. At this point, the energy stored in capacitor 244 begins to be depleted. However, with inverter switching now taking place, bootstrap circuit 260 begins to operate and provides the steady-state power needed to keep inverter driver circuit 230 operating. Capacitor 244 additionally serves as a filtering capacitor for storing energy provided by bootstrap circuit 260. Thus, startup circuit 240 provides a relatively small amount of energy for initially activating inverter driver circuit 230, while bootstrap circuit 260 supplies steady-state power for sustaining operation of inverter driver circuit 230.

Figure 4:
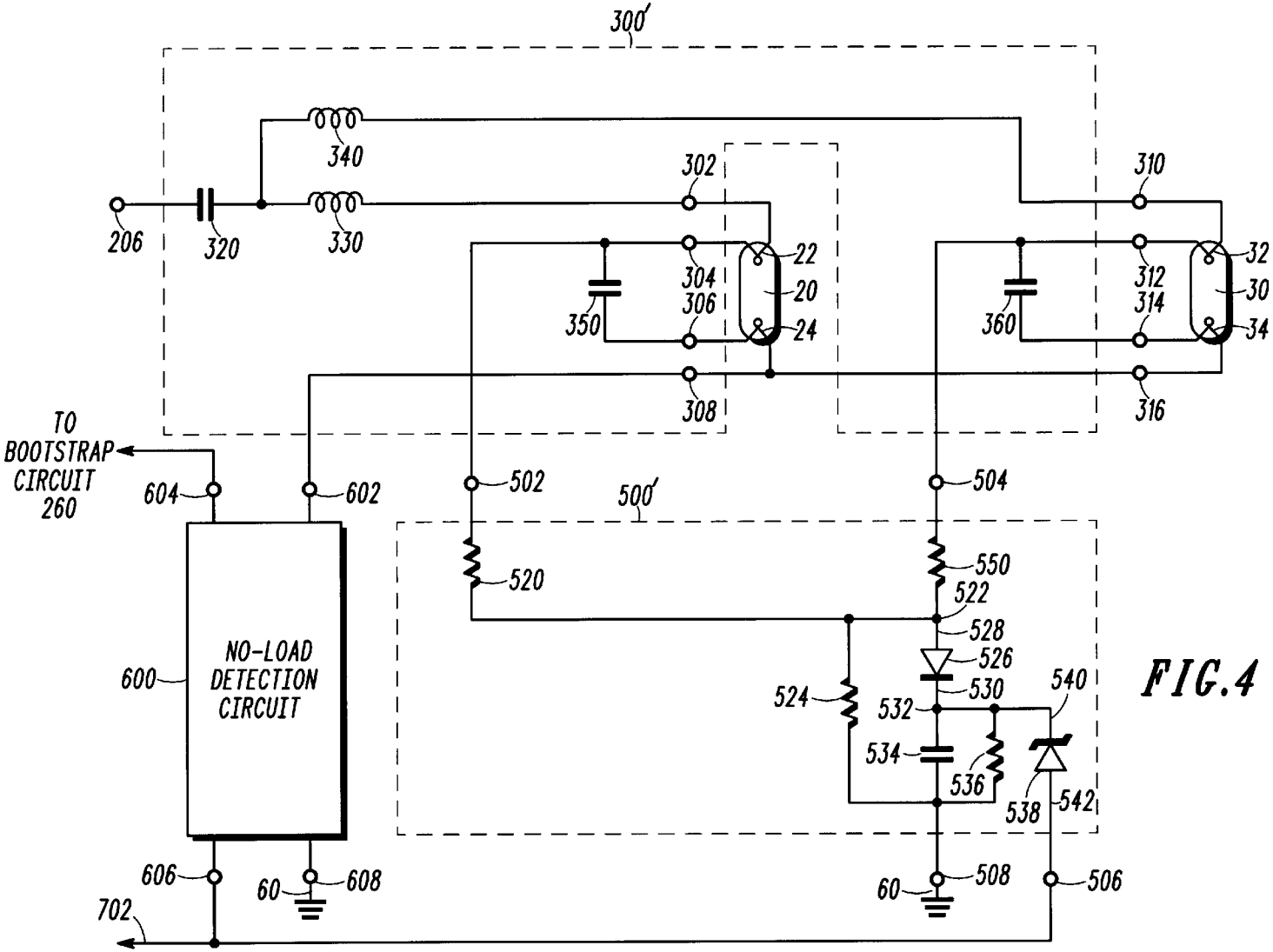
FIG. 4 is schematic diagram of an output circuit and a high voltage detection circuit for use in an electronic ballast for powering two gas discharge lamps, in accordance with a second preferred embodiment of the present invention.

Appropriate modifications can be made to output circuit 300 and high voltage detection circuit 500 to render ballast 10 suitable for powering more than one gas discharge lamp. In one such embodiment, as illustrated in FIG. 4, output circuit 300' additionally includes a second resonant inductor 340, a second resonant capacitor 360, and a second set of output wires 310, . . . ,316 adapted to being coupled to a second gas discharge lamp 30. Second resonant inductor 340 is coupled between first junction 322 and a fifth output wire 310. Second resonant capacitor is coupled between a sixth output wire 312 and a seventh output wire 314. Fifth output wire 310 is coupleable to sixth output wire 312 through a first filament 32 of lamp 30, while seventh output wire 314 is coupled to eighth output wire 316 through a second filament 34 of lamp 30. High voltage detection circuit 500' additionally includes a second high voltage detect input 504 that is coupled to sixth output wire 312, as well as a fourth resistor 550 coupled between second high voltage detect input 504 and first node 522. Fourth resistor 550 is analogous in function to resistor 520 and allows high voltage detection circuit 500' to monitor for overvoltage due to second lamp 30 becoming degassed or operating in the diode mode. As a result, high voltage detection circuit 500' is operable to effect engagement of latch circuit 700 if either one of the lamps is degassed or operating in the diode mode with both of its filaments intact.

As shown in FIG. 4, the combined return current of both lamps 20,30 flows into no-load detect input 602 of no-load detection circuit 600. Consequently, and recalling the previous discussion with regard to FIG. 2, both lamps must be removed or each lamp must have at least one open filament in order for no-load detection circuit 600 to effect engagement of latch circuit 700 (and, thus, shutdown of inverter driver circuit 230). For example, if lamp 20 is removed, while lamp 30 remains and operates normally, a nonzero return current is still provided to no-load detect input 602, thus preventing no-load detection circuit 600 from engaging latch circuit 700. Consequently, the inverter will not be shut down since removed lamp 20 presents no danger to continued safe operation of the inverter. On the other hand, if either lamp fails to conduct current in a normal manner, but both of its filaments remain intact (i.e., such as what may occur with a degassed or diode mode lamp), inverter driver circuit 230 will be shut down, regardless of the condition of the other lamp, in order to protect the inverter and output circuit from almost certain damage. In this way, protection circuit 400 provides a high degree of protection for inverter 200 under a number of lamp failure modes, yet accommodates "parallel" operation by which the remaining functional lamp is allowed to continue to operate, and thus provide useful illumination, if the other lamp is either (i) removed; or (ii) failed, with at least one open filament.

Although the present invention has been described with reference to a certain preferred embodiment, numerous modifications and variations can be made by those skilled in the art without departing from the novel spirit and scope of this invention.

What is claimed is:

1. An electronic ballast for powering a gas discharge lamp, comprising:

an AC-to-DC converter having a pair of input connections adapted to receive a source of alternating current, and a pair of output connections;

a set of output wires comprising first, second, third, and fourth output wires adapted to being coupled to a gas discharge lamp, wherein the first output wire is coupleable to the second output wire through a first filament of the lamp, and the third output wire is coupleable to the fourth output wire through a second filament of the lamp;

an inverter, comprising:

first and second input terminals coupled to the output connections of the AC-to-DC converter, the second input terminal being coupled to a circuit ground node;

an output terminal;

a first inverter switch coupled between the first input terminal and the output terminal;

a second inverter switch coupled between the output terminal and the circuit ground node;

an inverter driver circuit coupled to, and operable to complementarily commutate, the first and second inverter switches, the inverter driver circuit including a DC supply input for receiving operating power for the inverter driver circuit;

a startup circuit coupled between the AC-to-DC converter and the DC supply input of the inverter driver circuit, the startup circuit being operable to provide power for initiating operation of the inverter driver circuit; and a bootstrap circuit coupled between the inverter output terminal and the DC supply input of the inverter driver circuit, the bootstrap circuit having a ground connection coupled to the circuit ground node and being operable to provide steady-state operating power to the inverter driver circuit;

an output circuit comprising:

a DC blocking capacitor coupled between the inverter output terminal and a first junction;

a resonant inductor coupled between the first junction and the first output wire; and a resonant capacitor coupled between the second and third output wires; and an inverter protection circuit operable, in response to removal or failure of the lamp, to turn off the inverter driver circuit by coupling the DC supply input of the inverter driver circuit to the circuit ground node, the inverter protection circuit comprising:

a high voltage detection circuit having a high voltage detect input coupled to the second output wire, a ground connection coupled to the circuit ground node, and a high voltage detect output;

a no-load detection circuit having a no-load detect input coupled to the fourth output wire, a bootstrap detect input coupled to the bootstrap circuit, a no-load detect output coupled to the high voltage detect output, and a ground connection coupled to the circuit ground node; and a latch circuit having a latch input coupled to the no-load detect output, a latch output coupled to the DC supply input of the inverter driver circuit, and a ground connection coupled to the circuit ground node.

2. The electronic ballast of claim 1, wherein the inverter protection circuit is operable to inactivate the inverter driver circuit by coupling the DC supply input to the circuit ground node in response to at least one of:

(i) the voltage at the high voltage detect input being greater than a predetermined overvoltage threshold; and (ii) the current flowing into the no-load detect input being less than a predetermined no-load threshold.

3. The electronic ballast of claim 2, wherein the voltage at the high voltage detect input exceeds the predetermined overvoltage threshold in response to:

(i) both lamp filaments being intact; and (ii) failure of the lamp to conduct current in a substantially normal fashion.

4. The electronic ballast of claim 2, wherein the current flowing into the no-load detect input falls below a predetermined no-load threshold in response to at least one of:

(i) removal of the lamp; and (ii) failure of at least one filament of the lamp.

5. The electronic ballast of claim 1, wherein the first and second inverter switches each comprise at least one of a bipolar junction transistor and a field effect transistor.

6. The electronic ballast of claim 1, wherein the high voltage detection circuit comprises:

a first resistor coupled between the high voltage detect input and a first node;

a second resistor coupled between the first node and the circuit ground node;

a diode having an anode coupled to the first node and a cathode coupled to a second node;

a capacitor coupled between the second node and the circuit ground node;

a third resistor coupled between the second node and the circuit ground node; and a zener diode having a cathode coupled to the second node and an anode coupled to the high voltage detect output.

7. The electronic ballast of claim 1, wherein the no-load detection circuit comprises:

a first resistor coupled between the no-load detect input and the circuit ground node;

a first diode having a cathode coupled to the no-load detect input and an anode coupled to the circuit around node;

a second diode having an anode coupled to the no-load detect input and a cathode coupled to a first node;

a first capacitor coupled between the first node and the circuit ground node;

an electronic switch having a base lead, a collector lead, and an emitter lead, the emitter lead being coupled to the circuit ground node;

a second resistor coupled between the first node and the base lead of the electronic switch;

a third resistor coupled between the base lead of the electronic switch and the circuit ground node;

a third diode having an anode coupled to the bootstrap detect input and a cathode coupled to a second node;

a second capacitor coupled between the second node and the circuit ground node;

a fourth resistor coupled between the second node and the collector lead of the electronic switch; and a fourth diode having an anode coupled to the collector lead of the electronic switch and a cathode coupled to the no-load detect output.

8. The electronic ballast of claim 7, wherein the electronic switch comprises a NPN-type bipolar junction transistor.

9. The electronic ballast of claim 1, wherein the latch circuit comprises:

a first electronic switch having a base lead coupled to the latch input, an emitter lead coupled to the circuit ground node, and a collector lead;

a second electronic switch having a base lead, a collector lead, and an emitter lead, the emitter lead being coupled to the latch output;

a third electronic switch having a gate lead, a drain lead, and a source lead, the source lead being coupled to the circuit ground node;

a capacitor coupled between the latch input and the circuit ground node;

a first resistor coupled between the latch input and the circuit ground node;

a second resistor coupled between the latch input and the collector lead of the second electronic switch;

a third resistor coupled between the collector lead of the second electronic switch and the gate lead of the third electronic switch;

a fourth resistor coupled between the collector lead of the first electronic switch and the base lead of the second electronic switch;

a fifth resistor coupled between the latch output and the base lead of the second electronic switch; and a sixth resistor coupled between the latch output and the drain lead of the third electronic switch.

10. The electronic ballast of claim 9, wherein the first electronic switch comprises a NPN-type bipolar junction transistor, the second electronic switch comprises a PNP-type bipolar junction transistor, and the third electronic switch comprises a N-channel field effect transistor.

11. The electronic ballast of claim 1, wherein the bootstrap circuit comprises:

a capacitor coupled between the inverter output terminal and a first node, the first node being coupled to the bootstrap detect input of the no-load detection circuit;

a zener diode having a cathode coupled to the first node and an anode coupled to the circuit ground node;

a diode having an anode and a cathode, the anode being coupled to the first node; and a resistor coupled between the cathode of the diode and the DC supply input of the inverter driver circuit.

12. The electronic ballast of claim 1, wherein the AC-to-DC converter further comprises a rectifier circuit operable to accept the source of alternating current and to provide a rectified voltage between a pair of rectifier circuit output terminals.

13. The electronic ballast of claim 12, wherein the startup circuit comprises:

a resistor coupled between the DC supply input of the inverter driver circuit and one of the output terminals of the rectifier circuit; and a capacitor coupled between the DC supply input and the circuit ground node.

14. An electronic ballast for powering at least two gas discharge lamps, comprising:

an AC-to-DC converter having a pair of input connections adapted to receive a source of alternating current, and a pair of output connections;

a first set of output wires comprising first, second, third, and fourth output wires adapted to being coupled to a first gas discharge lamp, wherein:

the first output wire is coupleable to the second output wire through a first filament of the first lamp; and the third output wire is coupleable to the fourth output wire through a second filament of the first lamp;

a second set of output wires comprising fifth, sixth, seventh, and eighth output wires adapted to being coupled to a second gas discharge lamp, wherein:

the fifth output wire is coupleable to the sixth output wire through a first filament of the second lamp; and the seventh output wire is coupleable to the eighth output wire through a second filament of the second lamp, the eight output wire being coupled to the fourth output wire;

an inverter, comprising:

first and second input terminals coupled to the output connections of the AC-to-DC converter, the second input terminal being coupled to a circuit ground node;

an output terminal;

a first inverter switch coupled between the first input terminal and the output terminal;

a second inverter switch coupled between the output terminal and the circuit ground node;

an inverter driver circuit coupled to, and operable to complementarily commutate, the first and second inverter switches, the inverter driver circuit including a DC supply input for receiving operating power for the inverter driver circuit;

a startup circuit coupled between the AC-to-DC converter and the DC supply input of the inverter driver circuit, the startup circuit being operable to provide power for initiating operation of the inverter driver circuit; and a bootstrap circuit coupled between the first output terminal and the DC supply input of the inverter driver circuit, the bootstrap circuit being operable to provide steady-state operating power to the inverter driver circuit;

an output circuit comprising:

a direct current blocking capacitor coupled between the inverter output terminal and a first junction;

a first resonant inductor coupled between the first junction and the first output wire;

a second resonant inductor coupled between the first junction and the fifth output wire;

a first resonant capacitor coupled between the second and third output wires; and a second resonant capacitor coupled between the sixth and seventh output wires; and an inverter protection circuit, comprising:

a high voltage detection circuit having a first high voltage detect input coupled to the second output wire, a second high voltage detect input coupled to the sixth output wire, a ground connection coupled to the circuit ground node, and a high voltage detect output;

a no-load detection circuit having a no-load detect input coupled to the fourth output wire, a bootstrap detect input coupled to the bootstrap circuit, a no-load detect output coupled to the high voltage detect output, and a ground connection coupled to the circuit ground node;

a latch circuit having a latch input coupled to the no-load detect output, a latch output coupled to the DC supply input of the inverter driver circuit, and a ground connection coupled to the circuit ground node; and wherein the inverter protection circuit is operable to:

(a) terminate operation of the inverter driver circuit by coupling the DC supply input of the inverter driver circuit to the circuit ground node in response to at least one of: (i) removal of all of the gas discharge lamps; (ii) failure of at least one of the gas discharge lamps to conduct current in a substantially normal fashion; and (iii) all of the gas discharge lamps each having at least one open filament; and (b) allow continued operation of the inverter driver circuit, as long as: (i) at least one of the lamps is operating in a substantially normal fashion and with both of its filaments intact; and (ii) each of the failed lamps has at least one open filament.

15. The electronic ballast of claim 14, wherein:

the inverter protection circuit is operable, in response to the voltage at the high voltage detect input being greater than a predetermined overvoltage threshold, to shut down the inverter driver circuit by coupling the DC supply input to the circuit ground node; and the voltage at the high voltage detect input exceeds the predetermined overvoltage threshold in response to at least one of the lamps: (i) failing to conduct current in a substantially normal fashion; and (ii) having both of its filaments intact.

16. The electronic ballast of claim 15, wherein:

the inverter protection circuit is operable, in response to the current flowing into the no-load detect input being less than a predetermined no-load threshold, to shut down the inverter driver circuit by coupling the DC supply input to the circuit ground node; and the current flowing into the no-load detect input falls below the predetermined no-load threshold in response to at least one of:

(i) all of the lamps being removed; and (ii) all of the lamps each having at least one open filament.

17. The electronic ballast of claim 14, wherein the high voltage detection circuit comprises:

a first high voltage detect input coupled to the second output wire;

a second high voltage detect input coupled to the sixth output wire;

a high voltage detect output;

a first resistor coupled between the first high voltage detect input and a first node;

a second resistor coupled between the first node and the circuit ground node;

a diode having an anode coupled to the second node and a cathode coupled to a second node;

a capacitor coupled between the second node and the circuit ground node;

a third resistor coupled between the second node and the circuit ground node;

a zener diode having a cathode coupled to the second node and an anode coupled to the high voltage detect output; and a fourth resistor coupled between the second high voltage detect input and the first node.

18. The electronic ballast of claim 14, wherein the no-load detection circuit comprises:

a first resistor coupled between the no-load detect input and the circuit ground node;

a first diode having a cathode coupled to the no-load detect input and an anode coupled to the circuit ground node;

a second diode having an anode coupled to the no-load detect input and a cathode coupled to a first node;

a first capacitor coupled between the first node and the circuit ground node;

an electronic switch having a base lead, a collector lead, and an emitter lead, the emitter lead being coupled to the circuit ground node;

a second resistor coupled between the first node and the base lead of the electronic switch;

a third resistor coupled between the base lead of the electronic switch and the circuit ground node;

a third diode having an anode coupled to the bootstrap detect input and a cathode coupled to a second node;

a second capacitor coupled between the second node and the circuit ground node;

a fourth resistor coupled between the second node and the collector lead of the electronic switch; and a fourth diode having an anode coupled to the collector lead of the electronic switch and a cathode coupled to the no-load detect output.

19. The electronic ballast of claim 14, wherein the latch circuit comprises:

a first electronic switch having a base lead coupled to the latch input, an emitter lead coupled to the circuit ground node, and a collector lead;

a second electronic switch having a base lead, a collector lead, and an emitter lead, the emitter lead being coupled to the latch output;

a third electronic switch having a gate lead, a drain lead, and a source lead, the source lead being coupled to the circuit ground node;

a capacitor coupled between the latch input and the circuit ground node;

a first resistor coupled between the latch input and the circuit ground node;

a second resistor coupled between the latch input and the collector lead of the second electronic switch;

a third resistor coupled between the collector lead of the second electronic switch and the gate lead of the third electronic switch;

a fourth resistor coupled between the collector lead of the first electronic switch and the base lead of the second electronic switch;

a fifth resistor coupled between the latch output and the base lead of the second electronic switch; and a sixth resistor coupled between the latch output and the drain lead of the third electronic switch.

20. The electronic ballast of claim 14, wherein the bootstrap circuit comprises:

a capacitor coupled between the inverter output terminal and a first node, the first node being coupled to the bootstrap detect input of the no-load detection circuit;

a zener diode having a cathode coupled to the first node and an anode coupled to the circuit ground node;

a diode having an anode and a cathode, the anode being coupled to the first node; and a resistor coupled between the cathode of the diode and the DC supply input of the inverter driver circuit.

21. The electronic ballast of claim 14, wherein:

the AC-to-DC converter further comprises a rectifier circuit operable to receive the source of alternating current and to provide a rectified voltage between a pair of rectifier circuit output terminals; and the startup circuit comprises:

a resistor coupled between the DC supply input of the inverter driver circuit and one of the output terminals of the rectifier circuit; and a capacitor coupled between the DC supply input and the circuit ground node.

* * * * *

UNITED STATES PATENT AND TRADEMARK OFFICE

CERTIFICATE OF CORRECTION

PATENT NO. : 5,869,935

DATED : February 9, 1999

INVENTOR(S) : Sodhi

It is certified that error appears in the above-identified patent and that said Letters Patent is hereby corrected as shown below:

Column 9, claim 7, line 56 - 57 reads "an anode coupled to the circuit around node;" should be –an anode coupled to the circuit ground node; --.

Signed and Sealed this

Thirty-first Day of August, 1999

*Attest:*

Q. TODD DICKINSON

*Attesting Officer*

*Acting Commissioner of Patents and Trademarks*